US006236152B1

(12) United States Patent
Kimiya et al.

(10) Patent No.: US 6,236,152 B1
(45) Date of Patent: May 22, 2001

(54) COLOR CATHODE RAY TUBE WITH INLINE ELECTRON GUN WITH VARIABLE DISTANCES OF SIDE BEAM PASSING HOLES FROM THE CENTRAL BEAM PASSING AXIS

(75) Inventors: Junichi Kimiya, Fukaya; Fumitaka Hoshino, Gunma-ken; Shigeru Sugawara, Saitama-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/182,653

(22) Filed: Oct. 30, 1998

(30) Foreign Application Priority Data

Oct. 30, 1997 (JP) ..... 9-298065

(51) Int. Cl.[7] ..... H01J 29/50

(52) U.S. Cl. ..... 313/412; 313/414; 313/413; 313/449

(58) Field of Search ..... 313/412, 413, 313/414, 425, 449; 315/15, 382.1

(56) References Cited

U.S. PATENT DOCUMENTS 5,694,004 * 12/1997 Klmiya et al. ..... 315/15
5,751,100 * 5/1998 Kim ..... 313/414
5,936,338 * 8/1999 Takahashi ..... 313/414

FOREIGN PATENT DOCUMENTS 0103916 3/1984 (EP) .
0104674 4/1984 (EP) .
0119276 9/1984 (EP) .
0624894 11/1984 (EP) .
59-51440 3/1984 (JP) .
62-58549 3/1987 (JP) .

* cited by examiner

*Primary Examiner*—Ashok Patel
*Assistant Examiner*—Karabi Guharay
(74) *Attorney, Agent, or Firm*—Pillsbury Winthrop LLP

(57) ABSTRACT

A color cathode ray tube apparatus comprising an electron gun assembly of inline type including an electron beam generating section designed to emit three electron beams having axes extending in the same horizontal plane and a main electron lens section designed to focus the three electron beams emitted from the electron beam generating section. The main electron lens section has at least three grids G5, GM and G6 arranged in the order mentioned from the cathode side. The distance between the axis of the hole for guiding the center beam, made in the grid most close to the cathode side, and the axis of either hole for guiding a side beam, made in this gird, is shorter than the distance between the common axis of the coaxial holes for guiding the center beam, made in the control, accelerating and focusing electrodes constituting the electron beam generating section, and the common axis of either group coaxial holes for guiding a side beam, made in these control, accelerating and focusing electrodes. Hence, the spot which either side beam forms on the center of the phosphor screen when the three electron beams are focused by convergence magnets has no halos extending in the horizontal direction of the screen. As a result, the resultant image can have high resolution at any part of the phosphor screen.

10 Claims, 7 Drawing Sheets

COLOR CATHODE RAY TUBE WITH INLINE ELECTRON GUN WITH VARIABLE DISTANCES OF SIDE BEAM PASSING HOLES FROM THE CENTRAL BEAM PASSING AXIS

BACKGROUND OF THE INVENTION

The present invention relates to a color cathode ray tube apparatus, and more particularly to a color cathode ray tube apparatus that has a high-resolution electron gun.

Most color cathode ray tubes have a panel 1 and a funnel 2 that is formed integral with the panel 1, as is illustrated in FIG. 1. A phosphor screen 3 is provided as a target, opposing the inner surface of the panel 1. The phosphor screen 3 has a number of tricolor segments, each consisting of three stripes or dots of different colors. A shadow mask 4 having a number of apertures is provided, opposing the inner surface of the phosphor screen 3. The funnel 2 has a neck 5, in which an electron gun assembly 7 is arranged. The electron gun assembly 7 is designed to emit three electron beams 6B, 6G and 6R. A deflection yoke 8 is provided outside the funnel 2. The yoke 8 generates horizontal and vertical deflection magnetic fields. The magnetic fields deflect the electron beams 6B, 6G and 6R emitted from the assembly 7, in a horizontal direction and a vertical direction. The electron beams 6B, 6G and 6R thus deflected are applied through the shadow mask 4 to the phosphor screen 3. The screen 3 is thereby scanned in both the horizontal direction and the vertical direction. A color image is thereby displayed on the phosphor screen 3.

A so-called inline color cathode ray tube of self-convergence type has been put to practical use. The inline color-receiving tube has an electron gun assembly 7 that emits a center beam 6G and two side beams 6B and 6R, which have their axes extending in the same horizontal plane. The electron gun assembly has a main electron lens including a low-voltage grid and a high-voltage grid, each having three beam-guiding holes. The holes for guiding the side beams 6B and 6R, made in the low-voltage grid are eccentric to the holes for guiding the side beams 6B and 6R, made in the high-voltage grid. Thanks to this specific positioning of beam-guiding holes, the three electron beams are focused at a center part of the phosphor screen 3. Further, the deflection yoke 8 is designed to generate a horizontal deflection magnetic field shaped like a pincushion and a vertical deflection magnetic field shaped like a barrel. The pincushion-shaped magnetic field and the barrel-shaped magnetic field focus the three electron beams 6B, 6G and 6R at any part of the phosphor screen 3.

An electron gun assembly for use in this type of a color cathode ray tube is known. It is called "extended electric-field type," designed in order to improve the focusing of electron beams at any part of the phosphor screen. This electron gun assembly has a main electron lens having a long focal distance and a large aperture. The main electron lens is formed by such a method as is disclosed in Jpn. Pat. Appln. KOKAI Publication Nos. 61-39346 and 61-39347. That is, the focusing grid structure is not composed of only one grid but is comprised of segment grids, and the anode voltage is divided into partial voltages by a resistor arranged in the neck of the color cathode ray tube. The partial voltages, thus obtained, are applied to the segment grids of the focusing grid structure, which achieves moderate distribution of potential.

FIGS. 2A and 2B show an electron gun assembly of the extended electric-field type described above. As shown in FIG. 2A, the electron gun assembly has three cathodes KB, KG and KR, first to fifth grids G1 to G5, an intermediate electrode GM, sixth grid G6 and a convergence cup 90, which are arranged coaxial, in the order they are mentioned. The cathodes KB, KG and KR each incorporate a heater (not shown). The cathodes KB, KG and KR, girds G1 to G6, electrodes GM and convergence cup 90 are supported by and secured to an insulating support (not shown).

As shown in FIG. 2B, a resistor 100 is provided near the electron gun assembly. One end 110 of the resistor 100 is connected to the sixth grid G6. The other end of the resistor 100 is connected to the fifth grid G5. The resistor 100 is connected, at its middle point 120, to the intermediate electrodes GM. The end 110 of the resistor 100 is connected also to a voltage source 131, which applies an operating voltage to the electron gun assembly.

The first grid G1 is a thin-plate electrode and has three small beam-guiding holes. The second grid G2 is also a thin-plate electrode and has three small beam-guiding holes. The third grid G3 comprises a cups-shaped electrode 31 and a plate-shaped electrode 32, which abut on each other. The cup-shaped electrode 31 opposes the second grid G2 and has three beam-guiding holes slightly larger than the beam-guiding holes of the second grid G2. The holes for guiding one side beam, made in the first to third grids G1 to G3, have a common axis. Similarly, the holes for guiding the other side beam, made in these grids G1 to G3, have a common axis. The two side beams, therefore, travel along the common axes of the side beam guiding holes of the first to third girds G1 to G3. The plate-shaped electrode 32 of the third grid G3, which opposes the fourth grid G4, has three beam-guiding holes having a large diameter.

The fourth grid G4 comprises two cup-shaped electrodes, 41 and 42, which abut on each other. The electrodes 41 and 42 each have three beam-guiding holes having a large diameter. The fifth grid G5 comprises two cup-shaped electrodes 51 and 52, a thin-plate electrode 53, and a thick-plate electrode 54. The cup-shaped electrodes 51 and 52 each have three beam-guiding holes having a large diameter. The thin-plate electrode 53 has three beam-guiding holes that are elongated in the inline direction. The thick-plate electrode 54 has three beam-guiding holes having a large diameter. The intermediate electrode GM is a thick-plate electrode having three large beam-guiding holes. The sixth grid G6 comprises a thick-plate electrode 61, a thin-plate electrode 62 and two cup-shaped electrodes 63 and 64. The thick-plate electrode 61 has three beam-guiding holes. The thin-plate electrode 62 has three beam-guiding holes elongated in the inline direction. The cup-shaped electrodes 63 and 64 abut each other at their open ends. The convergence cup 90 is fastened to the bottom of the cup-shaped electrode 64.

A DC voltage of, for example, about 100 to 150V is applied to the cathodes KB, KG and KR. A modulation signal corresponding to an image is supplied also to the cathodes KB, KG and KR. The first grid G1 is connected to the ground. The second grid G2 and the fourth gird G4 are connected to each other in the tube. A DC voltage of about 600 to 800V is applied to the second and fourth grids G2 and G4. The cathodes KB, KG and KR and the first and second grids G1 and G2 compose a three-pole section for emitting electron beams and forming a crossover. The third grid G3 and the fifth grid G5 are connected to each other in the tube. A voltage of about 6 to 9V is applied to the third and fifth grids G3 and G5, serving as a focusing voltage. An anode voltage of about 25 to 30 kV is applied to the sixth grid G6.

The second grid G2 and the third grid G3 constitute a pre-focusing electron lens. The pre-focusing electron lens performs preliminary focusing on the electron beams emitted from the three-pole section. The third grid G3, fourth grid G4 and fifth grid G5 compose an auxiliary electron lens, which performs further preliminary focusing on the electron beams.

The resistor, provided near the electron gun assembly, applies a voltage to the intermediate grid GM. This voltage has a value almost halfway between the voltages applied to the fifth and sixth grids G5 and G6. In the electron gun assembly, the fifth grid G5, intermediate electrode GM and sixth grid G6 jointly form a main electron lens. The main electron lens focuses the electron beams finally on the phosphor screen of the color cathode ray tube that incorporates the electron gun assembly. The main electron lens is generally called "extended electric-field lens," because it is expanded by the intermediate electrode GM.

As shown in FIG. 2A, the axis of either hole for guiding a side beam, made in that end of the fifth grid G5 which oppose the intermediate electrode GM, is spaced by a distance Sg1 from the axis of the hole for guiding the center beam, made in that end. The axis of either hole for guiding a side beam, made in the intermediate electrode GM, is spaced by a distance Sg2 from the axis of the center beam. And the axis of either hole for guiding a side beam, made in that end of the sixth grid G6 which opposes the intermediate electrode GM, is spaced by a distances Sg3 from the axis of the hole for guiding the center beam made in that end of the sixth grid G6. The distances Sg1, Sg2 and Sg3 have the following relation:

$Sg1 \leqq Sg2 < Sg3$, or $Sg1 < Sg2 \leqq Sg3$

Both side beams are, therefore, deflected toward the center beam, so that the three electron beams may converged at the center part of the phosphor screen. At the center part of the phosphor screen, however, the three electron beams are not converted perfectly. Rather, the electron gun assembly is so designed to convert the three electron beams either a little inadequately or excessively at the center of the phosphor screen, before the electron gun assembly is incorporated into a color cathode ray tube.

After the tube-up process, or once the assembly is set in the color cathode ray tube, the assembly is adjusted so that the two-pole convergence magnet, four-pole convergence magnet and six-pole convergence magnet, all provided around the neck of the tube, may finally convert the electron beams at the center of the phosphor screen. Thus, the difference in beam converging, resulting from the difference in the conditions under which gun assemblies have been manufactured is eliminated.

Before incorporated into the tube, the assembly may be designed such that the three electron beams are converged inadequately, like most electron gun assemblies. In this case, the assembly is so adjusted after the tube-up process that the side electron beams are deflected toward the center electron beam and incident in the main electron lens by means of the convergence magnets.

As shown in FIG. 3A, the side electron beams are applied from the beam-emitting section to the main electron lens (i.e., the fifth grid G5, intermediate electrode GM and sixth grid G6). Hence, the side electron beams travel through a high-aberration section in the case where they are deflected toward the center electron beam. As a result, the beam spot 11 that the side beam 6B forms on the phosphor screen has halo 10 as shown in FIG. 3B. As shown in FIG. 3B, the halo 10 is extended in the direction opposite to the center beam 6G in the inline plane. The same is true for the beam spot formed on the phosphor screen by the side beam 6R travelling on the other side of the center beam 6G. Thus, the two side beams 6B and 6R have halos extending in the opposite direction. Consequently, the image formed on the phosphor screen is deteriorated very much. In FIG. 3A, CM is a convergence magnet.

BRIEF SUMMARY OF THE INVENTION

The object of the present invention is to provide a color cathode ray tube apparatus in which the side electron beams have no horizontal halos when the convergence magnets converges the three electron beams at the center of the phosphor screen, and a color image of high resolution can thereby be formed on the entire phosphor screen.

(1) According to a first aspect of the invention, there is provided a color cathode ray tube apparatus comprising:

an electron gun assembly of inline type for emitting a center electron beam and a pair of side electron beams, which are traveled in the same horizontal plane; and a deflection yoke for generating magnetic fields for deflecting the three electron beams emitted from the electron gun assembly, thereby to scan a target with the three electron beams, the electron gun assembly comprising:

an electron beam generating section which comprises a cathode for emitting the three electron beams, a control electrode for controlling the center electron beam and the side beams, an accelerating electrode for accelerating the center electron beam and the side electron beams, and a focusing electrode opposing the accelerating electrode, for focusing the center electron beam and the side beams, and in which the control electrode, accelerating electrode and focusing electrode each have a first hole for guiding the center electron beam, a second hole for guiding one side electron beam and a third hole for guiding the other side electron beam, the first holes of the control electrode, accelerating electrode and focusing electrode have a first axis in common, and the second holes of the control electrode, accelerating electrode and focusing electrode have a second axis in common, the third holes of the control electrode, accelerating electrode and focusing electrode have a third axis in common, and the second and third axes are spaced from the first axis by a first distance Sg0; and a main electron lens section for focusing the electron beams on the target, which comprises a first grid and a second grid, each having a center-beam guiding hole having the first axis, and in which the first grid has fourth and fifth holes for guiding the side electron beams, respectively, the second grid has sixth and seventh holes for guiding the side electrons, respectively, the fourth to seventh holes have fourth, fifth, sixth and seventh axes, respectively, the fourth and fifth axes are spaced from the first axis by a second distance Sg1, and the sixth and seventh axes are spaced from the first axis by a third distance Sg3, wherein the main electron lens has a structure for inclining paths of the side electron beams toward the center electron beam, and at least one of the second and third distances, Sg1 and Sg3, is shorter than the first distance Sg0.

(2) In the color cathode ray tube apparatus according to the first aspect, the second distance Sg1 and the third distance Sg3 are shorter than the first distance Sg0.

(3) In a second aspect of the color cathode ray tube apparatus similar to the first aspect, the main electron lens section further comprises a third grid which is arranged between the first and second grids, and has a center-beam guiding hole having the first axis, and eighth and ninth holes for guiding the side electron beams, respectively, the eighth and ninth holes have eighth and ninth axes, respectively, which are spaced from the first axis by a fourth distance Sg2, and the first to fourth distances, Sg0, Sg1, Sg3 and Sg2, have the following relation:

Sg1<Sg2≦Sg3, or

Sg1≦Sg2<Sg3 (wherein one of the distances Sg1, Sg2, and Sg3 is smaller than the distance Sg0 or all of the distances Sg1, Sg2, and Sg3 are smaller than the distance Sg0.)

(4) A third aspect of the cathode ray tube apparatus that is similar to the first aspect but wherein the main electron lens further comprises third and fourth grids which are arranged along traveling paths of the electron beams, are arranged between the first and second grids, have center holes having a common first center axis, for allowing the center beam to pass therethrough, and eighth and ninth side beam holes in the third grid, and tenth and eleventh side beam holes in the forth grid for allowing the side beams to pass therethrough, wherein the eight and ninth side beam holes have eight and ninth axes respectively, which are spaced a forth distance Sg2(1) from the first axis, and wherein the tenth and eleventh side beam holes have tenth and eleventh axes respectively which are spaced a fifth distance Sg2(2) from the first axis, and wherein the first, second, third, forth, and fifth distances Sg0, Sg1, Sg3, sg2(1) and Sg2(2) have the following relation:

Sg1<Sg2(1)≦Sg2(2)≦Sg3, or

Sg1<Sg2(1) and Sg2(2)<Sg3, wherein at least one of the distances Sg1, Sg2(1), Sg2(2), Sg3 is smaller than the distance Sg0 or all of the distances Sg1, Sg2, Sg3 are smaller than the distance Sg0.

(5) A forth aspect of the color cathode ray tube apparatus comprising:

an electron gun assembly of inline type for emitting a center electron beam and a pair of side electron beams, which are traveled in the same horizontal plane; and a deflection yoke generating magnetic fields for deflecting the three electron beams emitted from the electron gun assembly, thereby to scan a target with the three electron beams, the electron gun assembly comprising:

an electron beam generating section which comprises a cathode for emitting the three electron beams, a control electrode for controlling the center electron beam and the side beams, an accelerating electrode for accelerating the center electron beam and the side electron beams, and a focusing electrode opposing the accelerating electrode, for focusing the center electron beam and the side beams, and in which the control electrode, accelerating electrode and focusing electrode each have a first hole along a first axis for guiding the center electron beam, a second hole for guiding one side electron beam and a third hole for guiding the other side electron beam; and a main electron lens section for focusing the electron beams on the target, which comprises a first a second and a third grid, each having a center-beam guiding hole having the first axis, and in which the first grid has fourth and fifth holes for guiding the side electron beams, respectively, the second grid has sixth and seventh holes for guiding the side electrons, respectively, and the third grid has eight and nine holes for guiding the side electrons, respectively, wherein the beam guiding holes of the first grid have a diameter smaller than the beam guiding holes of the second grid, and the beam guiding holes of the second grid have a diameter smaller than the beam guiding holes of the third grid.

(6) According to a fifth aspect of the invention, there is provided a color cathode ray tube apparatus comprising:

an electron gun assembly of inline type for emitting a center electron beam and a pair of side electron beams, which have axes extending in the same horizontal plane; and a deflection yoke for deflecting the electron beams for generating magnetic fields for deflecting the three electron beams emitted from the electron gun assembly, thereby to scan a target with the three electron beams, the electron gun assembly comprising:

an electron beam generating section which comprises a cathode for emitting the three electron beams, a control electrode for controlling the center electron beam and the side beams, an accelerating electrode for accelerating the center electron beam and the side electron beams, and a focusing electrode opposing the accelerating electrode, for focusing the center electron beam and the side beams, and in which the control electrode, accelerating electrode and focusing electrode each have a first hole for guiding the center electron beam, a second hole for guiding one side electron beam and a third hole for guiding the other side electron beam, the first holes of the control electrode, accelerating electrode and focusing electrode have a first axis in common, and the second holes of the control electrode, accelerating electrode and focusing electrode have a second axis in common, the third holes of the control electrode, accelerating electrode and focusing electrode have a third axis in common, and the second and third axes are spaced from the first axis by a first distance Sg0; and a main electron lens section which is designed to focus the electron beams on the target, which comprises a first grid, and a second grid being arranged along the traveling path of the electron beams, each having a center-beam guiding hole having the first axis, and in which the first grid has fourth and fifth holes for guiding the side electron beams, respectively, the second grid has sixth and seventh holes for guiding the side electrons, respectively, the fourth to seventh holes have fourth, fifth, sixth and seventh axes, respectively, the fourth and fifth axes are spaced from the first axis by a second distance Sg1, and the sixth and seventh axes are spaced from the first axis by a third distance Sg3, wherein the main electron lens has a structure for inclining paths of the side electron beams toward the center electron beam, at least one of the second distance Sg1 and third distance Sg3 is smaller than the first distance Sg0, and the beam guiding holes of the first grid have a diameter smaller than the beam guiding holes of the second grid.

(7) In a sixth aspect of the color cathode ray tube apparatus similar to the fifth aspect, the main electron lens section further comprises a third grid which is arranged between the first and second grids, has a center-beam guiding hole having the first axis, and eighth and ninth holes for guiding the side electron beams, respectively, the eighth and ninth holes have eighth and ninth axes, respectively, which are spaced from the first axis by a fourth distance Sg2, the third distance Sg3 is longer than the fourth distance Sg2, and the beam guiding holes have sizes which are gradually increased depending on the arrangement of the respective grids in the traveling direction of the electron beams (i.e. the beam guiding holes of the first grid have a diameter smaller than the beam guiding holes of the third grid which in turn are smaller than the beam guiding holes of the second grid.)

(8) A seventh aspect of the apparatus similar to the fifth aspect, wherein the main electron lens further comprises third and fourth grids which are arranged between the first and second grids along traveling paths of the electron beams, have center holes having a common first center axis, for allowing the center beam to pass therethrough, and side beam holes for allowing the side beams, respectively, the side beam holes of the third grid having eighth and ninth axes which are spaced by a fourth distance Sg2(1) from the first axis, respectively, and the side beam holes of the fourth grid having tenth and eleventh axes which are spaced by a fifth distance Sg2(2) from the first axis, respectively, the first, second, third, and fifth distances Sg0, Sg1, Sg3, Sg2(1) and Sg2(2) have the following relation:

Sg1<Sg2(1)≦Sg2(2)≦Sg3, or

Sg1<Sg2(1) and Sg2(2)<Sg3, wherein at least one of the distances Sg1, Sg2(1), Sg2(2), Sg3 is smaller than the distance Sg0 or all of the distances Sg1, Sg2, Sg3 are smaller than the distance Sg0, and the beam guiding holes of the first grid have a diameter smaller than the beam guiding holes of the third grid, the beam guiding holes of the third grid are smaller than the beam guiding holes of the fourth grid, and the beam guiding holes of the fourth grid are smaller than the beam guiding holes of the second grid.

In the conventional electron gun assembly, high aberration inevitably occurs when only one-side part of either side beam diverging in the main electron lens region travels through that part of the side-beam guiding hole made in the main electron lens, which has a large aberration, when the convergence magnets deflect the side beams toward the axis of the center-beam guiding hole. In the electron gun assembly according to the present invention, the path of either side beam is substantially aligned with the axis of the hole for guiding the center beam after the convergence magnets deflect the side beams. The main electron lens has left and right regions corresponding to the aberration regions of the main electron lens in the in-line plane, which have substantially same divergent power. Therefore, the side beams passing through the both regions of the main electron lens are equally influenced by the aberration and are equally focused. The beam spot formed on the phosphor screen as the three electron beams are applied thereto have substantially no halos, though the side beams have been deflected to the center beam by the convergence magnets. As a result, a high-quality color image is formed on the phosphor screen.

Furthermore, in the color cathode ray tube apparatus according to the invention, the sizes of the apertures are gradually increased depending on the arrangement of the respective grids in the traveling direction of the beams. That is, the center and side beam apertures of the second grid are larger than that of the first grid, the center and side beam apertures of the third grid are larger than that of the second grid. Thus, the lens aperture of the main lens can be made large so that the aberration produced in the main lens region through which the side beam pass can be decreased. Thus, even if the side beams are deflected toward the center beam by the convergent magnet, the aberration applied to the side beams in the main lens region can be decreased so that the side beam halos extending in the in-line direction substantially can be suppressed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode ray tube apparatus according to the first embodiment of the present invention will be described, with reference to FIGS. 4A and 4B and FIGS. 5A and 5B.

Figure 1:
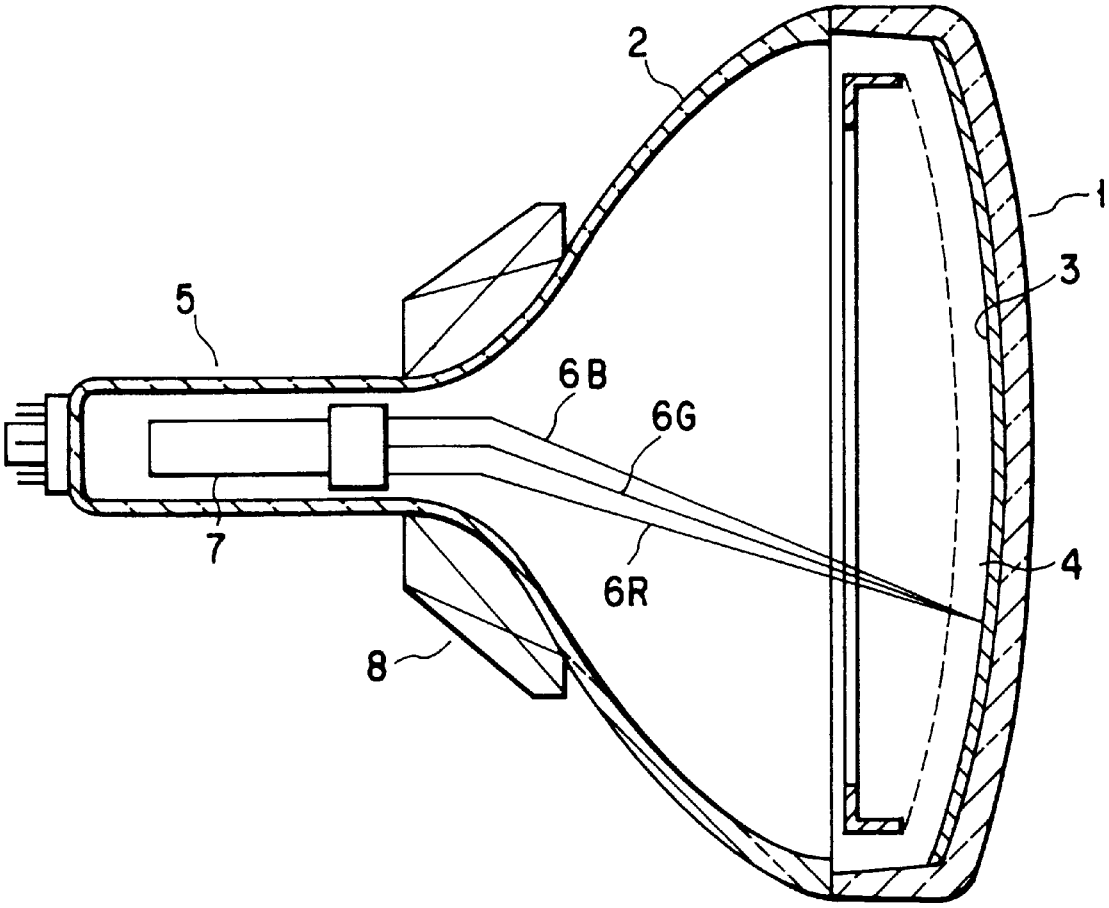
FIG. 1 (PRIOR ART)
FIG. 1 is a sectional view of a conventional color cathode ray tube.
Figure 2A:
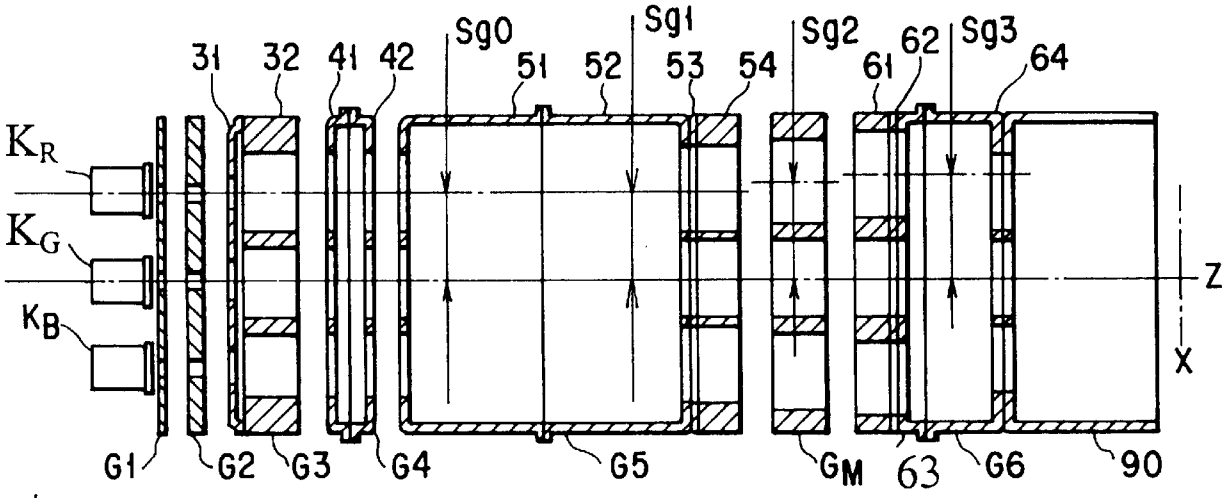
FIG. 2A (PRIOR ART)
FIGS. 2A and 2B are a sectional plan view and a sectional side view, respectively, schematically showing the electron gun assembly incorporated in the conventional color cathode ray tube.
Figure 2B:
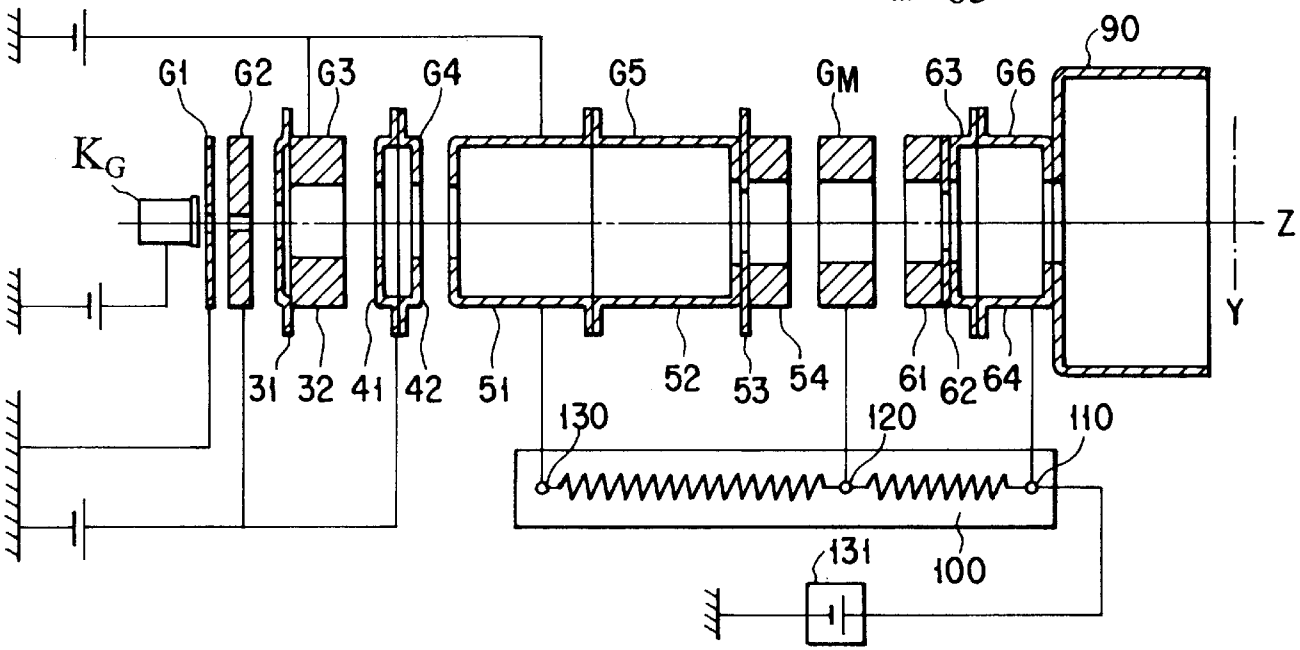
FIG. 2B (PRIOR ART)
Figure 4A:
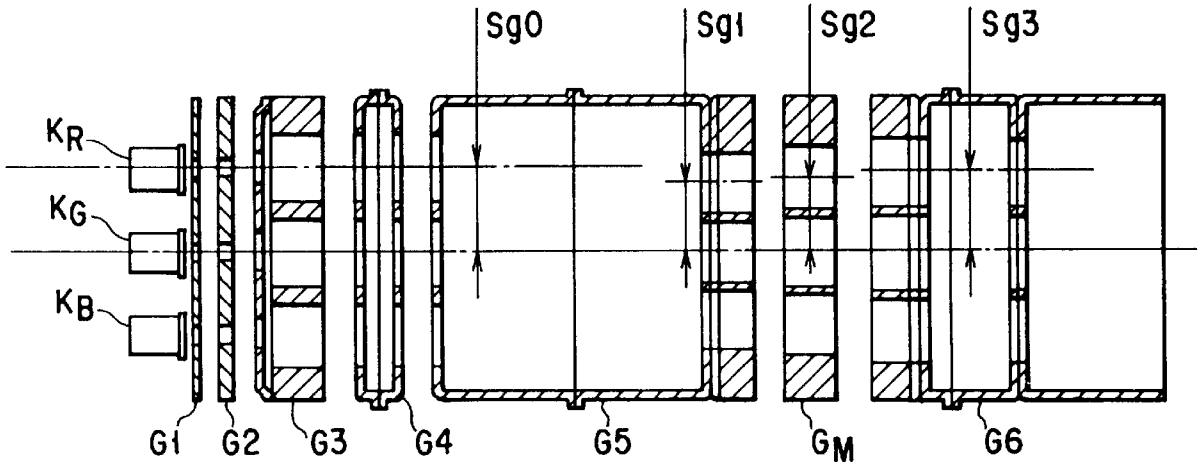
FIGS. 4A and 4B are a sectional plan view and a sectional side view, respectively, schematically showing the electron gun assembly according to an embodiment of this invention.
Figure 4B:
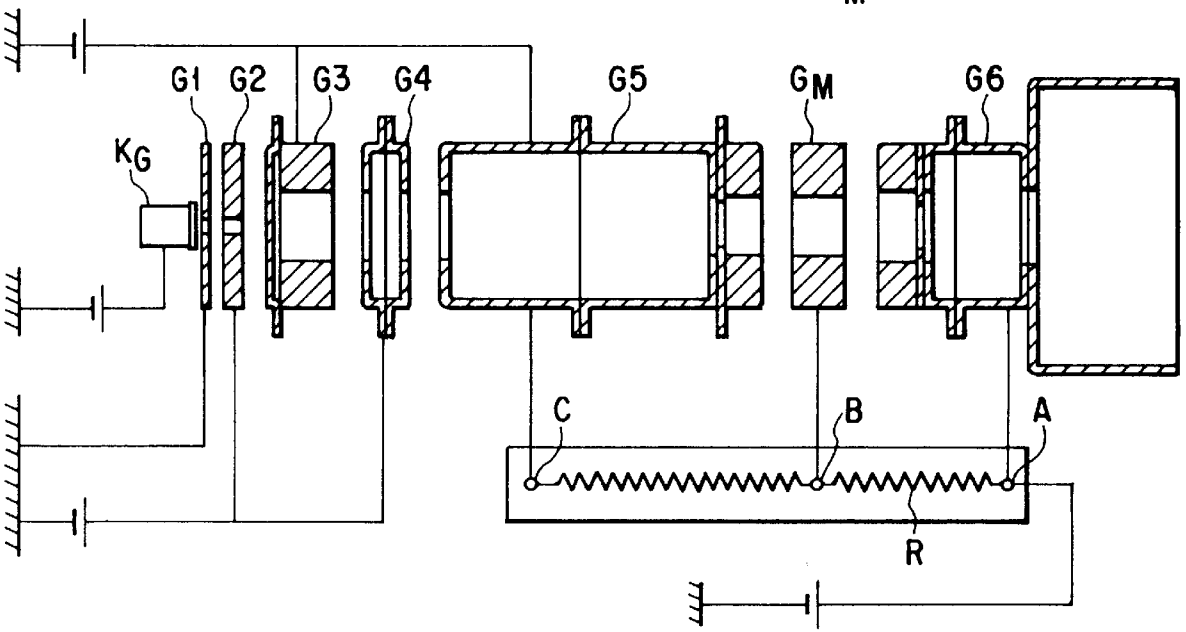

FIGS. 4A and 4B are schematic sectional views of the electron gun assembly provided in the color cathode ray tube apparatus according to the first embodiment of the invention. The color cathode ray tube apparatus is almost identical in structure to the conventional one shown in FIG. 1. Therefore, the structure of the tube will not be described. For its structure, refer to FIG. 1 and the description pertaining thereto.

As shown in FIG. 4A, the electron gun assembly has three cathodes KB, KG and KR, first to fifth grids Gi to G5, an intermediate electrode GM, sixth grid G6 and a convergence cup, which are arranged coaxial, in the order they are mentioned. The cathodes KB, KG and KR each incorporate a heater (not shown). The cathodes KB, KG and KR, girds G1 to G6, electrodes GM and convergence cup 90 are supported by and secured to an insulating support (not shown).

As shown in FIG. 4B, a resistor R is provided near the grids. One end A of the resistor R is connected to the sixth grid G6. The other end C of the resistor R is connected to the fifth grid G5. The resistor 100 is connected, at its middle point M, to the intermediate electrodes GM.

The first grid Gi is a thin-plate electrode and has three small beam-guiding holes. The second grid G2 is also a thin-plate electrode and has three small beam-guiding holes. The third grid G3 comprises a cup-shaped electrode and a thick-plate electrode, which abut on each other. The cup-shaped electrode opposes the second grid G2 and has three beam-guiding holes slightly larger than the beam-guiding holes of the second grid G2. The thick-plate electrode opposes the fourth grid G4 and has three beam-guiding holes having a large diameter. The holes for guiding one side bean, made in the first to third grids G1 to G3, have a common axis. Similarly, the holes for guiding the other side beam, made in these grids G1 to G3, have a common axis.

The fourth grid G4 comprises two cup-shaped electrodes, which abut on each other. These cup-shaped electrodes each have three beam-guiding holes having a large diameter. The fifth grid G5 comprises two cup-shaped electrodes, a thin-plate electrode, and a thick-plate electrode, which are arranged in the order they are mentioned, from the cathodes KR, KG and KB. The cup-shaped electrodes each have three beam-guiding holes having a large diameter and abut on each other. The thin-plate electrode has three beam-guiding holes that are elongated in the inline direction. The thick-plate electrode has three beam-guiding holes having a large diameter. The intermediate electrode GM is a thick-plate electrode having three large beam-guiding holes.

The sixth grid G6 comprises a thick-plate electrode, a thin-plate electrode and two cup-shaped electrodes, arranged in the order they are mentioned. The thick-plate electrode has three beam-guiding holes of a large diameter. The thin-plate electrode has three large beam-guiding holes elongated in the inline direction. The cup-shaped electrodes abut each other at their open ends. The cup-shaped electrodes each have three beam-guiding holes.

A DC voltage (EK) of about 100 to 150V is applied to the cathodes KB, KG and KR. The first grid G1 is connected to the ground. A DC voltage (Ec2) of about 600 to 800V is applied to the second and fourth grids G2 and G4. A focusing voltage (Ec3) of about 6 to 9V is applied to the third and fifth grids G3 and G5. An anode voltage (Eb) of about 25 to 30 kV is applied to the sixth grid G6. The resistor R, provided near the electron gun assembly, applies a voltage to the intermediate grid GM. This voltage has a value almost halfway between the voltages applied to the fifth and sixth grids G5 and G6.

The axis of either hole for guiding a side beam, made in that electrode of the fifth grid G5, which opposes the intermediate electrode GM, is spaced by a distance Sg1 from the axis of the hole for guiding the center beam, made in that electrode. The axis of either hole for guiding a side beam, made in the intermediate electrode GM, is spaced by a distance Sg2 from the axis of the hole for guiding the center beam, made in the intermediate electrode GM. The axis of either hole for guiding a side beam, made in that electrode of the sixth grid G6, which opposes the intermediate electrode GM, is spaced by a distance Sg3 from the axis of the hole for guiding the center beam, made in that electrode of the sixth grid G6. The axes of the holes for guiding side beams, made in the first and second grids G1 and G2, are spaced by a distance Sg0 from the common axis of the holes for guiding the center beam, made in the first and second grids Gi and G2. The distances Sg0 to Sg3 have the following relation:

$Sg1<Sg2<Sg3<Sg0$

In accordance with this relation, the beam-guiding holes, including those for guiding the center beam, made in the grids G5, GM, G6 are sequentially larger in this order. That is, beam-guiding holes of the fifth grid G5 is smaller than that of the intermediate electrode GM and the beam-guiding holes of the grid G2 is smaller than that of the third grid G3. Thus the following relation is established.

$DG5<DGM<DG6$

Wherein, DG5 is each dimension of the side and center beam-guiding hole of the fifth grid G5, DGM is each dimension of the side and center beam-guiding hole of the intermediate electrode GM, and DG6 is each dimension of the side and center beam-guiding hole of the sixth grid G6.

Figures 3A, 3B:
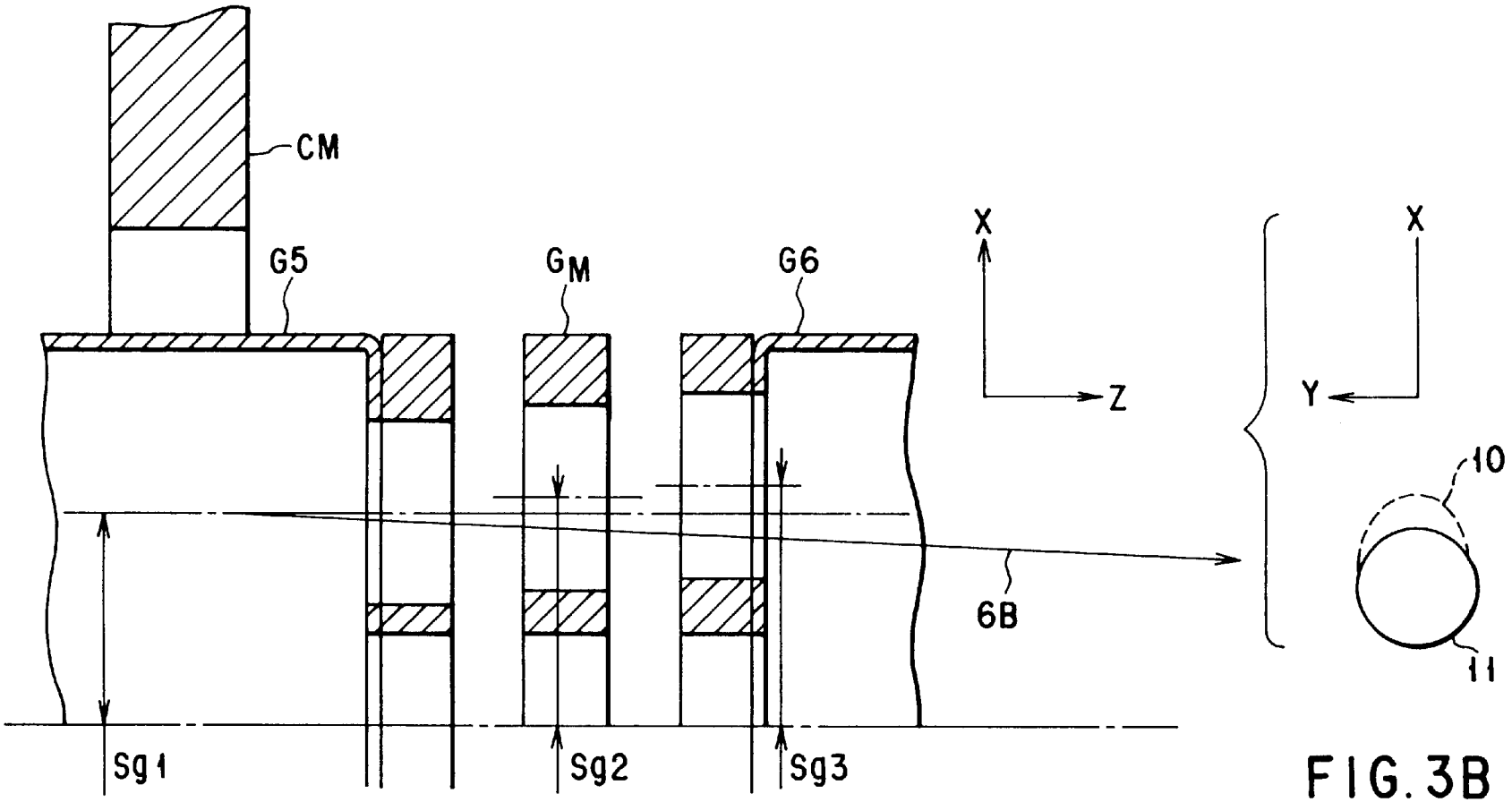
FIGS. 3A and 3B are diagrams for explaining the operation of the electron gun assembly incorporated in the conventional color cathode ray tube.
Figure 5B:
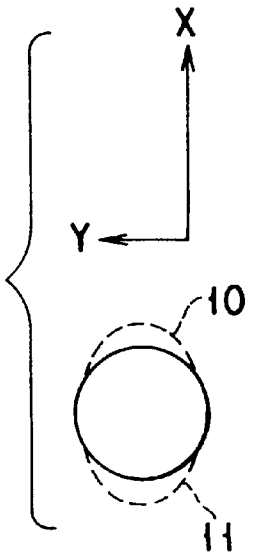
FIGS. 5A and 5B are diagrams for explaining the operation of the electron gun assembly incorporated in the color cathode ray tube illustrated in FIGS. 4A and 4B.
Figure 5A:
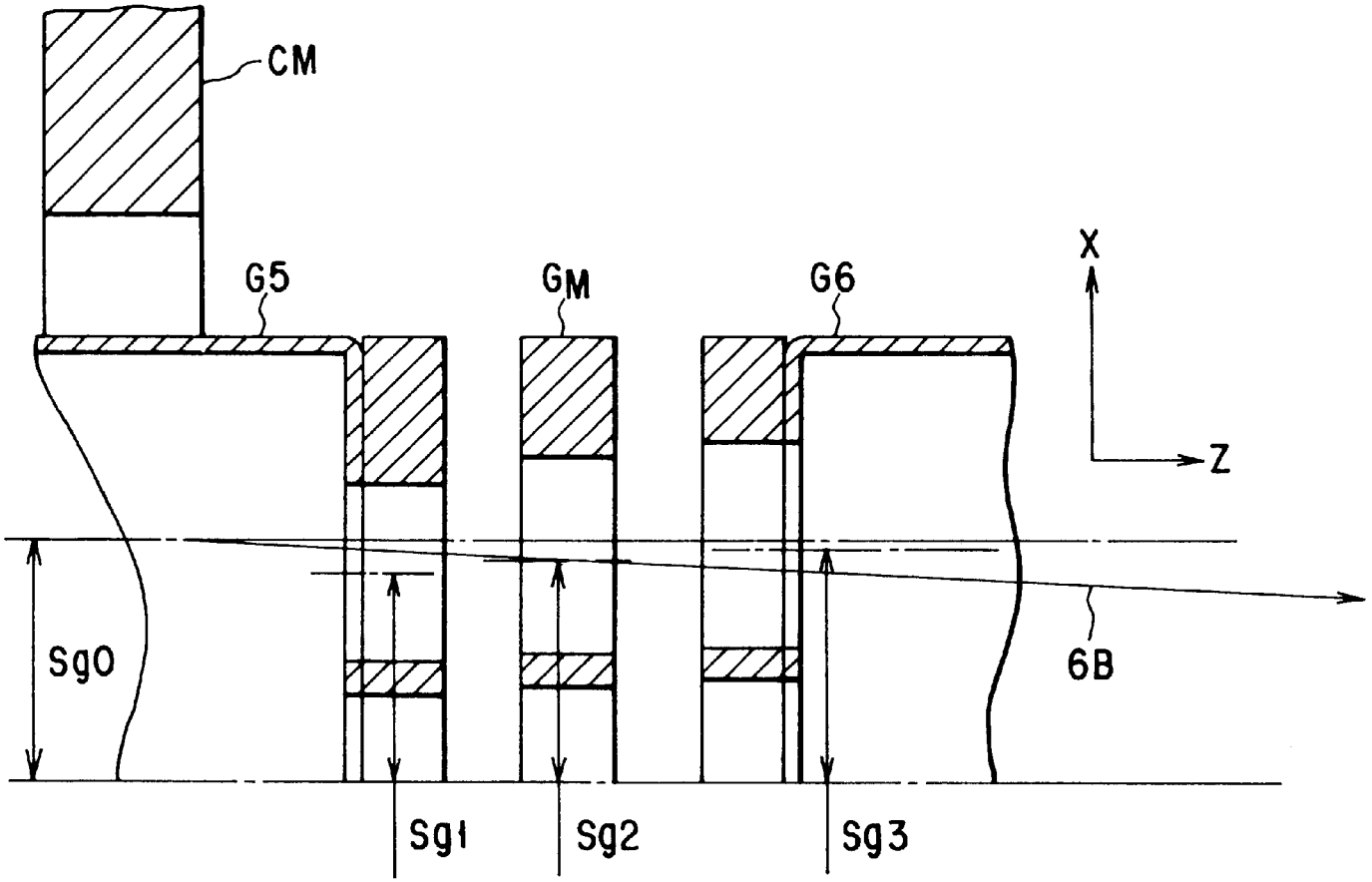

In the conventional electron gun assembly, the side beams travel through that part of the main electron lens which is near the holes for guiding the center beam and which has large aberration, when the paths of the side electron beams are deflected toward the center beam by the convergence magnets. In the electron gun assembly of the structure shown in FIGS. 4A and 4B, the paths of the side beams 6B and 6R are deflected by the convergence magnets and are therefore substantially aligned with the axis of the holes for guiding the center beam as shown in FIG. 5A. (In FIG. 5A, only beam 6B is shown.) This is because the holes for guiding the side beams are closer to the holes for guiding the center beam in the main electron lens. Therefore, the beam spots 11 that the side beams form on the phosphor screen have no halos 10 as shown in FIG. 5B. By contrast, in the conventional electron gun assembly, the beam spots that side beams form have halo 10 with aberration in the direction opposite to the center beam 6G in the inline plane as shown in FIG. 3B.

As indicated above, the paths of the side beams are substantially aligned with the axis of the holes for guiding the center beam after the convergence magnets deflect the side beams. The side beams are diverged at a same manner in the aberration regions of the main electron lens. Thus, the side beams can be focused in the same way. This is why the beam spots formed by the side beams have no halos.

Further, the beam-guiding holes of the fifth grid are smaller than those of the intermediate electrode, which are in turn smaller than those of the sixth grid, in the same relation as the relation between the distances Sg1, Sg2 and Sg3, each between the axis of either hole for guiding a side beam and the axis of the center beam, i.e., $Sg1<Sg2<Sg3$. Hence, the main electron lens can have a large aperture, and the aberration of the main electron lens can be decreased.

In the present embodiment, the distances Sg1, Sg2 and Sg3, each distance being between the axis of either hole for guiding a side beam and the axis of the center beam, have the following relation:

$Sg1<Sg2<Sg3<Sg0$.

With this structure, too, the same advantages are attained as in the structure illustrated in FIGS. 4A and 4B.

The present invention is not limited to this specific case. Alternatively, the distances Sg1, Sg2 and Sg3 may have an average which is less than the distance Sg0.

Still alternatively, $Sg1 \leqq Sg2<Sg0 \leqq Sg3$.

Further, the beam-guiding holes of the fifth grid need not be smaller than those of the intermediate electrode, which need not be smaller than those of the sixth grid, in the same relation as $Sg1<Sg2<Sg3$.

As mentioned above, that electrode of the fifth grid G5 which opposes the intermediate electrode GM and that electrode of the sixth grid G6 which opposes the intermediate electrode GM are thick-plates ones. Instead, the electron gun assembly may have the structure shown in FIGS. 6A and 6B.

Figure 6B:
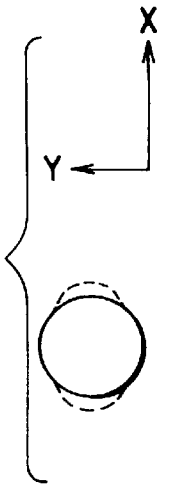
FIGS. 6A and 6B are a sectional plan view and a sectional side view, respectively, schematically showing an electron gun assembly according to another embodiment of the invention.
Figure 6A:
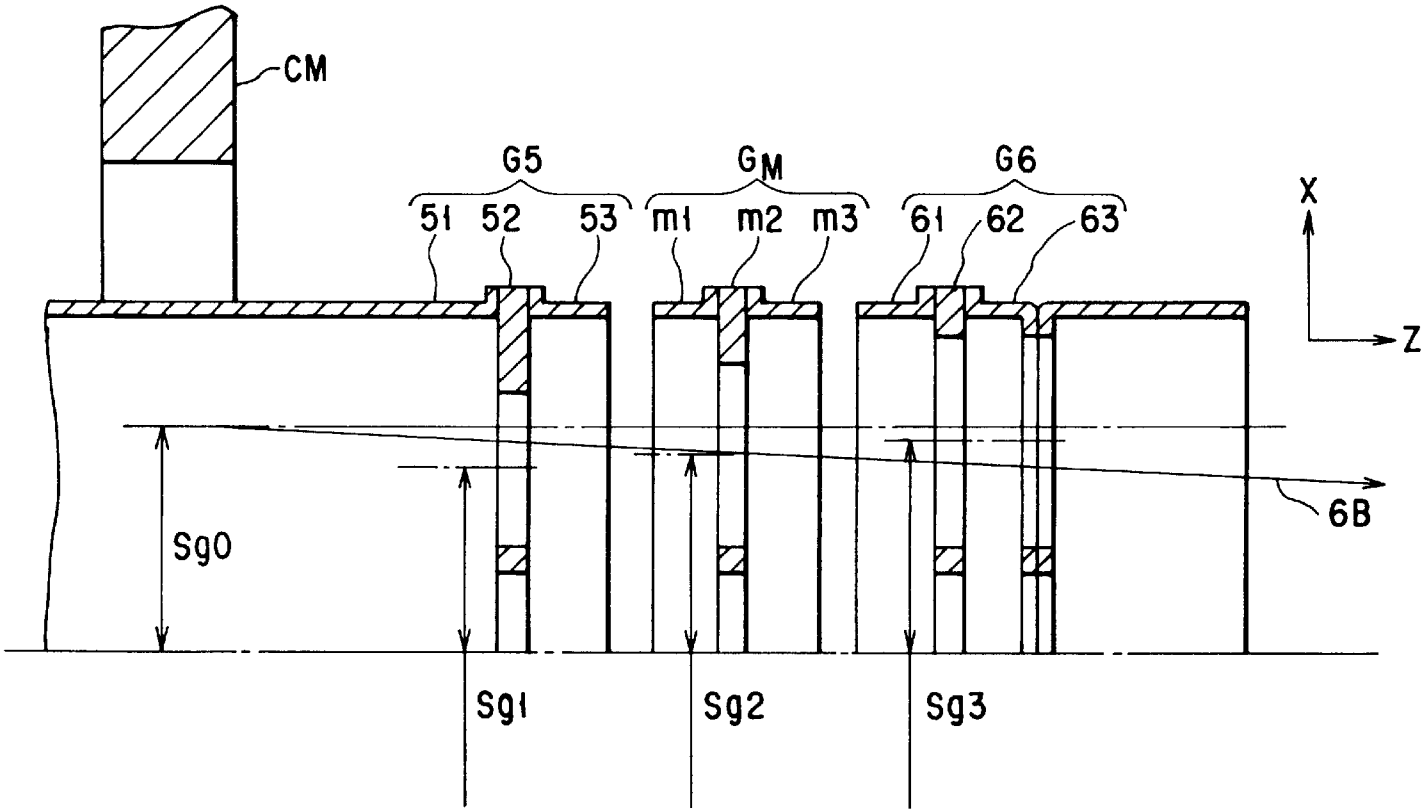

As illustrated in FIGS. 6A and 6B, that end portion of the fifth grid G5 which opposes the intermediate electrode GM comprises a thick-plate electrode 52 and an annular electrode 53. The plate electrode 52 has three large holes for guiding electron beams, whereas the annular electrode 53 as one opening for guiding all electrons. The intermediate electrode GM comprises a plate electrode m2 and two annular electrodes m1 and m3. The thick-plate electrode m2 has three large holes for guiding electron beams, whereas the annular electrodes m1 and m3 each have one opening for guiding all electrons. That end portion of the sixth grid G6 which oppose the intermediate electrode GM comprises a plate electrode 62 and two annular electrodes 61 and 63. The thick-plate electrode 62 has three large holes for guiding electron beams, whereas the annular electrodes 61 and 63 each have one opening for guiding all electrons.

The axis of either hole for guiding a side beam, made in the electrode 52 of the fifth grid G5, which opposes the intermediate electrode GM, is spaced from the axis of the center beam by a distance Sg1. The axis of either hole for guiding a side beam, made in the electrode m2 of the intermediate electrode GM, which is located between the fifth and sixth grids G5 and G6, is spaced from the axis of the center beam by a distance Sg2. The axis of either hole for guiding a side beam, made in the electrode 62 of the sixth grid G6, which opposes the intermediate electrode GM, is spaced from the axis of the center beam by a distance Sg3. The axes of the holes for guiding side beams, made in the first and second grids G1 and G2 which compose an electron beam generating section, are spaced from the axis of the center beam by a distance Sg0. The distances Sg0 to Sg3 have the following relation:

$Sg1<Sg2<Sg3<Sg0$.

In accordance with this relation, the beam-guiding holes, including those for guiding the center beam, made in the grids G5, GM, G6 are sequentially larger in this order. That is, beam-guiding holes of the fifth grid G5 is smaller than that of the intermediate electrode GM and the beam-guiding holes of the grid G2 is smaller than that of the third grid G3. Thus the following relation is established.

$DG5<DGM<DG6$

Wherein, DG5 is each dimension of the side and center beam-guiding hole of the fifth grid G5, DGM is each dimension of the side and center beam-guiding hole of the intermediate electrode GM, and DG6 is each dimension of the side and center beam-guiding hole of the sixth grid G6. With this structure, too, the same advantages are attained as in the structure illustrated in FIGS. 4A and 4B.

Figure 7:
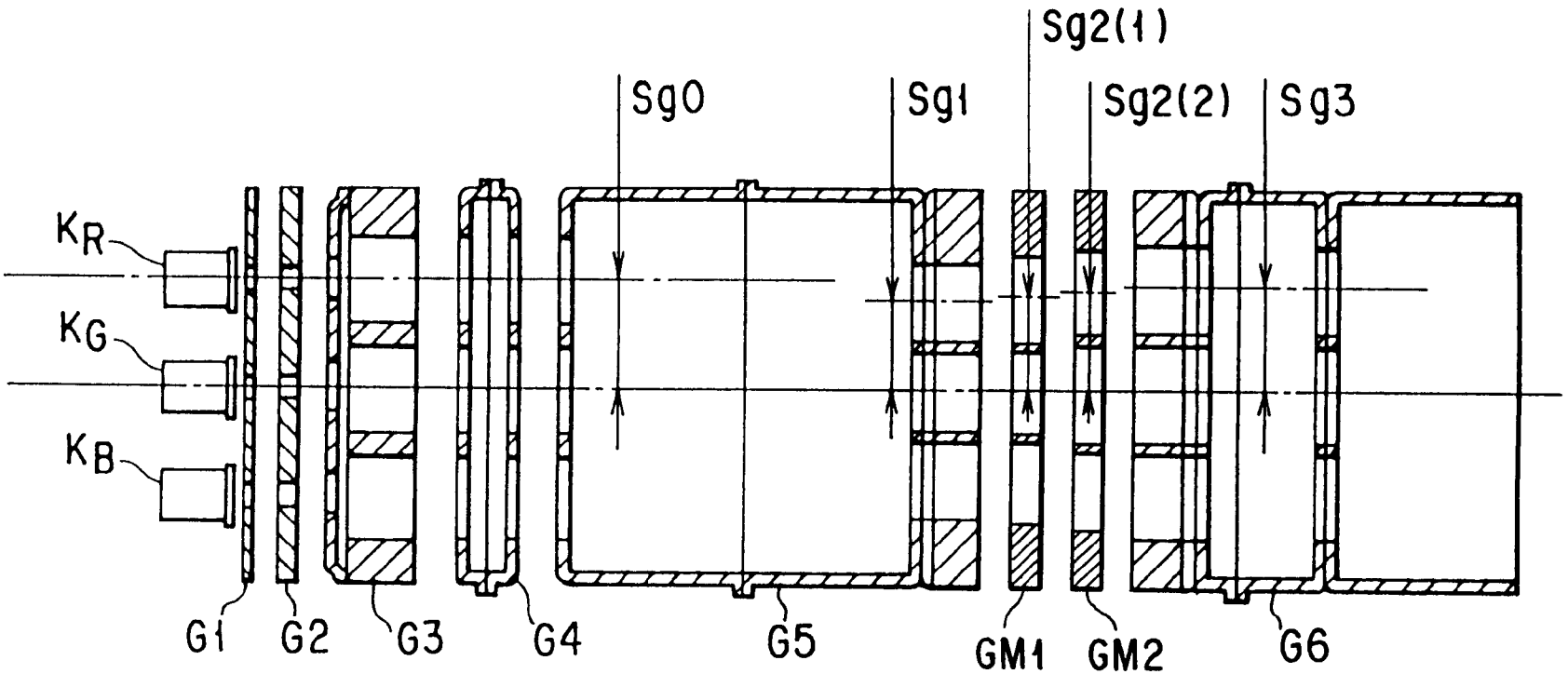
FIG. 7 is a sectional plan view schematically showing the electron gun assembly according to yet another embodiment of the invention.

In the embodiment shown in FIGS. 4A and 4B, it is not limited that the intermediate electrode GM constituting the main electron lens is constituted by only one intermediate electrode. That is, the intermediate electrode GM constituting main electron lens may be constituted by two or more intermediate electrode GM1 and GM2, as shown in FIG. 7. That is, intermediate electrodes GM1 and GM2 constituting the main electron lens are arranged between the fifth and sixth grids G5 and G6 along traveling paths of the electron beams. The intermediate electrodes GM1 and GM2 have center holes having a common first center axis, for allowing the center beam to pass therethrough, and side beam holes for allowing the side beams, respectively. The side beam holes of the intermediate electrode GM1 have axes which are spaced by a distance Sg2(1) from the center axis, respectively, and the side beam holes of the intermediate electrode GM2 have axes which are spaced by a distance Sg2(2) from the center axis, respectively, the distances Sg0, Sg1, Sg3, Sg2(1) and Sg2(2) have the following relation:

$Sg1<Sg2(1)\leqq Sg2(2)\leqq Sg3$, or $Sg1<Sg2(1)$ and $Sg2(2)<Sg3$, wherein at least one of the distances Sg1, Sg2(1), Sg2(2), Sg3 is smaller than the distance Sg0 or all of the distances Sg1, Sg2, Sg3 are smaller than the distance Sg0, and the beam guiding holes of the grids G5 have a diameter smaller than the beam guiding holes of the electrode GM1, the beam guiding holes of the electrode GM1 are smaller than the beam guiding holes of the electrode GM2, and the beam guiding holes of the electrode GM2 are smaller than the beam guiding holes of the electrode G6. The main electron lens so arranged as to symmetrically apply the lens aberrations to the side beams in the in-line plane, the side beams being emitted from the electron beam forming section and deflected to the center beam by the convergence magnet. With this structure, too, the same advantages are attained as in the structure illustrated in FIGS. 4A and 4B.

The advantages of the embodiment of the present invention have been described. For further understanding of the invention, the embodiment will be compared with the conventional electron gun assemblies disclosed in Jpn. Pat. Appln. KOKAI Publication Nos. 59-51440 and 62-5849.

In the assemblies disclosed in the Publication Nos. 59-51440 and 62-5849, the distance SG between the axis of the hole for guiding the center beam, made in the acceleration electrode equivalent to the second grid G2, and the axis of either hole for guiding a side beam, made in the acceleration electrode, differs from the distance GS between the axis of the hole for guiding the center beam, made in the convergence electrode equivalent to the third grid G3, and the axis of either hole for guiding a side beam, made in the convergence electrode. As a result, the side beams are deflected toward the center beam. Particularly, in the electron gun assembly disclosed in Jpn. Pat. Appln. KOKAI Publication No. 59-51440, the side beams thus deflected are not further deflected toward the center beam while they are traveling through the grids. This is because the distances SG for the grids are the same.

Hence, the present invention differs from the electron gun assemblies disclosed in Jpn. Pat. Appln. KOKAI Publication Nos. 59-51440 and 62-5849, in the following respects:

(1) In the present invention, the distance between the axis of the hole for guiding the center beam, made in the second grid G2, and the axis of either hole for guiding a side beam, made in the second grid G2, is the same as the distance between the axis of the hole for guiding the center beam, made in the third grid G3, and either hole for guiding a side beam, made in the third grid G3. Therefore, the side beams are not deflected toward the center beam, while traveling from the second grid G2, which is equivalent to the acceleration electrode, to the third grid G3, which is equivalent to the convergence electrode. As a result, the side beams are not influenced by the aberration of the electron lens when they are deflected by the electron lens.

Generally, an acceleration electrode G2 and a convergence electrode G3 have small beam-guiding holes, and the electron beams pass through these electrodes at low speed. The side beams are therefore greatly influenced by the aberration of the electron lens as they are deflected by this electron lens. Consequently, the focused state of the side beams much deteriorates. In view of this, it is desirable that the side beams are not influenced by the aberration of the electron lens at a position where the aberration is prominent, so that the side beams may assume a good focused state.

(2) In the present invention, the side beams are deflected toward the center beam, not by a single means. Rather, they are deflected by two means. More precisely, the side beams are deflected first by the convergence magnets CM and then by the main electron lens, after they have traveled through the first grid G1 (i.e., a control electrode), the second grid G2 (i.e., an acceleration electrode) and the third grid G3 (i.e., a convergence electrode). In other words, the side beams are deflected toward the center beam by at least two means. If the main electron lens used in the electron gun assembly may be extended type which has an intermediate electron lens, it deflects the side beams twice. In this case, the side beams are deflected by three means.

Since both side beams are gradually deflected by at least two deflection means, the lens aberration of each deflection means can be reduced as much as possible. Thus, the total lens aberration resulting from the deflection of the side beam can be decreased greatly.

As described above, the color cathode ray tube apparatus according to this invention comprises an electron gun assembly of inline type and a yoke for generating magnetic fields that deflect electron beams emitted from the gun assembly and focus them on a target. The gun assembly has a beam generating section and a main electron lens section. The beam generating section emits three electron beams traveling in the same horizontal plane, i.e., two side electron beams and one center electron beam. The main electron lens section comprises a plurality of grids that focus the electron beams on the target.

In the conventional electron gun assembly, high aberration inevitably occurs when only one-side part of either side beam diverging in the main electron lens region travels through that part of the side-beam guiding hole made in the main electron lens, which has a large aberration, when the convergence magnets deflect the side beams toward the axis of the center-beam guiding hole. In the electron gun assembly according to the present invention, the path of either side beam is substantially aligned with the axis of the hole for guiding the center beam after the convergence magnets deflect the side beams. The main electron lens has left and right regions corresponding to the aberration regions of the main electron lens in the in-line plane, which have substantially same divergent power. Therefore, the side beams passing through the both regions of the main electron lens are equally influenced by the aberration and are equally focused. The beam spot formed on the phosphor screen as the three electron beams are applied thereto have substantially no halos, though the side beams have been deflected to the center beam by the convergence magnets. As a result, a high-quality color image is formed on the phosphor screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube apparatus comprising:

an inline type electron gun assembly of inline type for emitting three electron beams including a center electron beam and a pair of side electron beams, which travel in the same horizontal plane; and a deflection yoke for generating magnetic fields for deflecting the three electron beams, thereby to scan a target with the three electron beams, said electron gun assembly comprising:

an electron beam generating section comprising a center beam cathode and first and second side beam cathodes for emitting the three electron beams, a control electrode for controlling the center electron beam and the side beams, an accelerating electrode for accelerating the center electron beam and the side electron beams, and a focusing electrode opposing the accelerating electrode, for focusing the center electron beam and the side beams, in which the control electrode, accelerating electrode and focusing electrode each have a first hole for guiding the center electron beam, a second hole for guiding one side electron beam and a third hole for guiding the other side electron beam, the center beam cathode and the first holes of the control electrode, accelerating electrode and focusing electrode have a first axis in common, the first side beam cathode and the second holes of the control electrode, accelerating electrode and focusing electrode have a second axis in common, the second side beam electrode and the third holes of the control electrode, accelerating electrode and focusing electrode have a third axis in common, and the second and third axes are spaced from the first axis by a first distance Sg0; and a main electron lens section of electric field extended type for focusing the electron beams on the target, the electron lens section comprising a first grid, second grid and a third grid, each having a center-beam guiding hole along the first axis, and in which the first grid has fourth and fifth holes for guiding the side electron beams, respectively, the second grid has sixth and seventh holes for guiding the side electron beams, respectively, the third grid has eighth and ninth holes for guiding the side electron beams, respectively, the fourth to ninth holes have fourth, fifth, sixth, seventh, eighth and ninth axes, respectively, the fourth and fifth axes are spaced from the first axis by a second distance Sg1, the sixth and seventh axes are spaced from the first axis by a third distance Sg3, and the eighth and ninth axes are spaced from the first axis by a fourth distance Sg2, and the first to fourth distances, Sg0, Sg1, Sg3 and Sg2 have the following relation:

$Sg1 < Sg2 \leqq Sg3$, or $Sg1 \leqq Sg2 < Sg3$ wherein at least one of the distances Sg1, Sg2, Sg3 is smaller than the distance Sg0.

2. An apparatus according to claim 1, wherein the distances Sg1, Sg2, Sg3 are smaller than the distance Sg0.

3. An apparatus according to claim 1, wherein the distances Sg1, Sg2 are smaller than the distance Sg0.

4. An apparatus according to claim 1, wherein the beam guiding holes of the first grid have a diameter smaller than the beam guiding holes of the third grid, and the beam guiding holes of the third grid have a diameter smaller than the beam guiding holes of the second grid.

5. An apparatus according to claim 1, wherein the main electron lens has a structure for inclining paths of the side electron beams toward the center electron beam.

6. A color cathode ray tube apparatus comprising:

an electron gun assembly of the inline type for emitting three electron beams including a center electron beam and a pair of side electron beams, which travel in the same horizontal plane; and a deflection yoke for generating magnetic fields for deflecting the three electron beams emitted from the electron gun assembly, thereby to scan a target with the three electron beams;

said electron gun assembly comprising:

an electron beam generating section comprising a center beam cathode and first and second side beam cathodes for emitting the three electron beams, a control electrode for controlling the center electron beam and the side beams, an accelerating electrode for accelerating the center electron beam and the side electron beams, and a focusing electrode opposing the accelerating electrode, for focusing the center electron beam and the side beams, in which the control electrode, accelerating electrode and focusing electrode each have a first hole for guiding the center electron beam, a second hole for guiding one side electron beam and a third hole for guiding the other side electron beam, the center beam cathode and the first holes of the control electrode, accelerating electrode and focusing electrode have a first axis in common, the first side beam cathode and the second holes of the control electrode, accelerating electrode and focusing electrode have a second axis in common, the second side beam cathode and the third holes of the control electrode, accelerating electrode and focusing electrode have a third axis in common, and the second and third axes are spaced from the first axis by a first distance Sg0; and a main electron lens section of electric field extended type for focusing the electron beams on the target, the electron lens section comprising a first grid, second grid, a third grid and fourth grid, each having a center-beam guiding hole having the first axis, in which the first grid has fourth and fifth holes for guiding the side electron beams, respectively, the second grid has sixth and seventh holes for guiding the side electron beams, respectively, the third grid has eighth and ninth holes for guiding the side electron beams, respectively, the fourth grid has tenth and eleventh holes for guiding the side electron beams, respectively, the fourth to eleventh holes have fourth, fifth, sixth, seventh, eighth, ninth, tenth, and eleventh axis, respectively, the fourth and fifth axes are spaced from the first axis by a second distance Sg1, the sixth and seventh axes are spaced from the first axis by a third distance Sg3, the eighth and ninth axes are spaced from the first axis by a fourth distance Sg2(1), and the tenth and eleventh axes are spaced from the first axis by a fifth distance Sg2(2), and the first to fifth distances, Sg0, Sg1, Sg3, Sg2(1) and Sg2(2) have the following relation:

$Sg1 < Sg2(1) \leqq Sg2(2) \leqq Sg3$, or $Sg1 < Sg2(1)$ and $Sg2(2) < Sg3$, wherein at least one of the distances Sg1, Sg3, Sg2(1), Sg2(2) is smaller than the distance Sg0.

7. An apparatus according to claim 6, wherein the distances Sg1, Sg2(1), Sg2(2) are smaller than the distance Sg0.

8. An apparatus according to claim 6, wherein the distances Sg1, Sg3, Sg2(1), Sg2(2) are smaller than the distance Sg0.

9. An apparatus according to claim 6, wherein the beam guiding holes of the first grid have a diameter smaller than the beam guiding holes of the third grid, the beam guiding holes of the third grid are smaller than the beam guiding holes of the fourth grid, and the beam guiding holes of the fourth grid are smaller than the beam guiding holes of the second grid.

10. An apparatus according to claim 6, wherein the main electron lens is constructed and arranged so that the side electron beams follow paths toward the center electron beam.

* * * * *